United States Patent [19]

McIntyre et al.

[11] 4,279,709

[45] Jul. 21, 1981

[54] PREPARATION OF POROUS ELECTRODES

[75] Inventors: John M. McIntyre; Donald L. Caldwell, both of Lake Jackson, Tex.

[73] Assignee: The Dow Chemical Company, Midland, Mich.

[21] Appl. No.: 37,206

[22] Filed: May 8, 1979

[51] Int. Cl.[3] ..... C25B 1/34; C25B 11/02; C25B 11/04; C25B 11/10

[52] U.S. Cl. ..... 204/98; 204/128; 204/290 R; 204/290 F; 204/291; 204/292; 427/34; 427/245; 427/352; 427/423

[58] Field of Search ..... 204/35 R, 98, 128, 290 R, 204/290 F, 32 R, 291–292; 427/352, 34, 423, 245, 205, 353; 428/469, 471

[56] References Cited

U.S. PATENT DOCUMENTS

| | | | |
|---|---|---|---|
| 489,284 | 7/1874 | Hooner | 204/290 R |
| 1,263,959 | 4/1918 | Swartley | 204/290 R |
| 2,241,095 | 5/1941 | Marvin | 29/189 |
| 2,598,318 | 5/1952 | Teal | 204/35 R |
| 2,858,256 | 10/1958 | Fahnoe et al. | 204/35 R |
| 2,928,783 | 3/1960 | Bacon | 204/283 |
| 2,969,315 | 1/1961 | Bacon | 204/234 |
| 2,999,798 | 9/1961 | Eitel et al. | 204/35 R |
| 3,067,045 | 12/1962 | McMahon | 106/14 |
| 3,219,730 | 11/1965 | Bliten et al. | 204/0.5 |
| 3,272,728 | 9/1966 | Hahndorff et al. | 204/35 |
| 3,287,142 | 11/1966 | Russell | 106/14 |
| 3,316,159 | 4/1967 | Lautos | 204/23 |
| 3,326,725 | 6/1967 | Guth et al. | 136/120 |
| 3,403,057 | 9/1968 | Stankavich et al. | 136/120 |
| 3,427,204 | 2/1969 | Clune et al. | 136/126 |
| 3,492,720 | 2/1970 | Guthke et al. | 29/592 |
| 3,497,425 | 2/1970 | Cotton et al. | 204/37 |
| 3,630,770 | 12/1971 | Favreau | 117/230 |
| 3,649,355 | 3/1972 | Hennig | 117/217 |
| 3,681,136 | 8/1972 | Leonard et al. | 117/230 |
| 3,713,891 | 1/1973 | Curelop | 136/30 |
| 3,788,968 | 1/1974 | Müller et al. | 204/290 R |
| 3,802,878 | 4/1974 | Lindstrom | 75/208 R |
| 3,945,907 | 3/1976 | Gokhale | 204/266 |
| 3,974,058 | 8/1976 | Gokhale | 204/266 |
| 3,992,278 | 11/1976 | Malkin | 204/242 |
| 4,024,044 | 5/1977 | Brannan et al. | 204/290 R |

FOREIGN PATENT DOCUMENTS

| | | | |
|---|---|---|---|
| 40-21495 | 8/1965 | Japan | 204/129 |

*Primary Examiner*—R. L. Andrews

[57] ABSTRACT

Electrodes with porous coatings are produced using an inorganic compound which is soluble in an aqueous solution, as the pore former in the coating. The inorganic pore former may be removed from the coating while the electrode is being used in an electrolytic cell without contaminating the electrolyte. Such electrodes are particularly useful in electrolytic cells, wherein they operate at a significantly lower voltage and have a longer life span than conventional electrodes.

13 Claims, No Drawings

PREPARATION OF POROUS ELECTRODES

BACKGROUND OF THE INVENTION

This invention relates to an improved process for manufacturing electrodes which are to be used in electrolytic cells, for example, a chlor-alkali electrolytic cell.

In a typical chlor-alkali electrolytic cell a saturated brine solution is electrolyzed by passing electric current through it in a specially designed cell having a diaphragm or a membrane between the cathode and the anode. Chlorine is produced at the anode while sodium hydroxide (NaOH) and hydrogen ($H_2$) are formed at the cathode. Brine is fed continuously to the cells, while and $Cl_2$, NaOH and $H_2$ are continously withdrawn from the cells.

Currently, there are three types of electrolytic cells in commercial use for the production of chlor-alkali: (1) the mercury cell, (2) the diaphragm cell, and (3) the membrane cell. The operation of each of these cells is discussed in Volume 1 of the Third Edition of the *Kirk-Othmer Encyclopedia of Chemical Technology* page 799 et. seq.

The minimum voltage required to electrolyze an electrolyte into $Cl_2$, NaOH and $H_2$ may be calculated using the thermodynamic data. However, in commercial practice, the theoretical amount of voltage is not achievable and, higher voltages must be used to overcome the various resistances inherent in the various types of cells. To increase the efficiency of the operation of a diaphragm or a membrane cell one may attempt to reduce the overvoltages of the electrodes, to reduce the electrical resistance of the diaphragm or membrane, or reduce the electrical resistance of the brine being electrolyzed. The invention herein described results in an electrode particularly useful as a cathode in the electrolysis of brine; cathode overvoltage is substantially reduced, resulting in increased power efficiencies.

Because of the multi-million-ton quantity of alkali metal halides and water electrolyzed each year, even a reduction of as little as 0.05 volts in working voltage translates to meaningful economic savings, especially with today's constantly increasing power costs. Consequently, the industry has sought means to reduce this voltage requirement.

Throughout the development of chlor-alkali technology, various methods have been developed to reduce this cell voltage. Certain practitioners have concentrated on reducing cell voltage by modifying the physical design of the electrolytic cell, while others have concentrated their efforts on reducing the overvoltage at the anode or the cathode. The present invention concerns itself with an improved process to make a cathode that is characterized by a significantly lower overvoltage than cathodes that are generally used commercially.

It is well known that an electrode's overvoltage is a function of the current density and its composition (Reference: *Physical Chemistry,* 3rd ed.—W. J. Moore, Prentice Hall (1962), pp. 406–408), where the current density refers to the amperage applied per unit of true surface area of an electrode and composition refers to the chemical and physical makeup of the electrode. Therefore, a process that will increase an electrode's surface area will decrease its overvoltage at a given apparent current density. It is also desirable to use a composition of matter that is a good electrocatalyst; this further reduces the overvoltage.

It is well known in the art to use plasma or flame spraying to coat an electrode with an electroconductive metal. In U.S. Pat. No. 1,263,959 it was taught that anodes may be coated by spraying fine nickel particles onto an anode, wherein the particles are rendered molten and impacted on the iron substrate by means of a blast.

Cathodes, also, have been coated with electroconductive metals. In U.S. Pat. No. 3,992,278, cathodes were coated by plasma spraying or flame spraying an admixture of particulate cobalt and particulate zirconia. When these electrodes are used for the electrolysis of water or an aqueous alkali metal halide salt solution, they give prolonged lowering of hydrogen overvoltage.

Various metals and combinations of metals have been used to coat electrodes by plasma or flame spraying: U.S. Pat. No. 3,630,770 teaches the use of lanthanum boride; U.S. Pat. No. 3,649,355 teaches the use of tungsten or tungsten alloy; U.S. Pat. No. 3,788,968 teaches the use of titanium carbide or titanium nitride and at least one metal and/or metal oxide of the platinum group and a second oxide coating which is porous; U.S. Pat. No. 3,945,907 teaches the use of rhenium and; U.S. Pat. No. 3,974,058 teaches the use of cobalt as a coating with an overcoat of ruthenium.

It is, likewise, well known in the art to make porous electrodes by selective leaching. Coating an electrode with particulate nickel, then sintering the nickel as taught in U.S. Pat. Nos. 2,928,783 and 2,969,315; electrodepositing an alloy onto a substrate then leaching out one component of the alloy as taught in U.S. Pat. No. 3,272,788; pressing or cementing two or more components together or onto an electrode substrate and then selectively leaching out one or more of the coating components as illustrated by U.S. Pat. Nos. 3,316,159; 3,326,725; 3,427,204; 3,713,891 and 3,802,878.

It is also known in the art to combine the steps of making electrodes by plasma—or flame—spraying followed by leaching. It is also known to combine the steps of electroplating followed by leaching. Examples of known methods are illustrated in the following patents; U.S. Pat. No. 3,219,730 teaches coating a substrate with a multiple oxide film coating then removing the substrate by leaching, thus forming an electrode; U.S. Pat. No. 3,403,057 teaches flame or plasma spraying a Raney alloy onto a substrate followed by leaching aluminum out of the alloy, thus leaving a porous electrode; U.S. Pat. No. 3,492,720 teaches plasma spraying tungsten, titanium or alloys thereof along with aluminum, thorium and zirconium oxides onto a substrate. The substrate was subsequently removed, leaving a porous electrode.

U.S. Pat. No. 3,497,425 teaches preparing porous electrodes by coating the substrate with a relatively insoluble metal followed by a coating of a more easily dissolvable metal. The teaching requires heat treating to cause inter-diffusion of the two coats, while optimum conditions require separate heat treatments for each coat. The dissolvable metal is subsequently leached out, leaving a porous electrode. U.S. Pat. No. 3,618,136 teaches forming porous electrodes by coating a binary salt composition onto a substrate and leaching a soluble component from the system. The patent teaches that it is critical that the binary salt mixture is a eutectic composition and that optimum results are obtained when the same anions are used for both the active and the inactive salts, e.g. silver chloride—sodium chloride.

Netherlands Pat. Application No. 75-07550 teaches the preparation of porous cathodes by applying to a substrate a coating of at least one non-noble metal from the group of nickel, cobalt, chromium, manganese and iron, alloyed with a secondary, less noble, sacrificial metal followed by removal of at least a part of this sacrifical metal. Specifically, the sacrificial metal is chosen from the group of zinc, aluminum, magnesium and tin. The sacrificial metal is removed by leaching with a lye solution or an acid solution.

Japanese Pat. No. 31-6611 teaches forming a porous electrode by electroplating onto a substrate a nickel coating followed by a coating of zinc or some other soluble substance which is soluble in an alkaline solution. These coated electrodes are then either immersed in an alkaline solution or subjected to an electrochemical anodizing treatment to elute and remove zinc and other soluble substances, thus forming a porous electrode. Prior to immersion, a heat treatment of the coated electrode is required in some embodiments.

The present invention is a novel improvement over all of the known prior art of making electrodes with porous coatings by flame—or plasma—spraying followed by leaching, because of its incorporation of an inorganic compound as the pore former and because of the unique and unexpected benefits derived therefrom.

One benefit of the present invention is that it is significantly more economical than other known methods to produce electrodes with porous coatings by selective leaching. When the inorganic compound pore former of the present invention is used, such as sodium chloride, potassium chloride, calcium chloride, magnesium chloride, lithium chloride, etc., the cost of the pore former is much less than when metallic pore formers are used, such as aluminum, zinc, thorium, zirconium, manganese, iron and others taught in the prior art.

This invention does not require the use of an alloy as a coating material, as is required by several other known methods. Neither does the present invention require the use of a binary salt mixture, wherein the binary salt mixture is a eutectic composition nor is there need to treat the electrodes with heat after the coating has been applied but before leaching occurs, as is required by certain inventions of the prior art.

It is an object of the present invention to provide cathodes particularly well suited for use in electrolyzing aqueous alkali metal halide solutions in cells having diaphragm or membrane separators, which cathode has reduced hydrogen overvoltage, good life span, the ability to be produced from a variety of cathode substrates to desired configurations and which does not contain any contaminant which will be leachable into the electrolytic solution.

These and other benefits will be obvious to one skilled in the art to which this invention relates.

BRIEF DESCRIPTION OF THE INVENTION

The electrodes comprise an electrically conductive substrate bearing on at least a part of its surface a high surface area metal coating produced by applying an admixture of particulate metal and a particulate inorganic compound pore former and then leaching out the inorganic compound pore former. Such electrodes, when used to electrolyze aqueous alkali metal halide salt solutions in cells having a diaphragm or membrane separator and when the metal salt is the same alkali metal halide salt as the electrolyte reduce the hydrogen overvoltage, exhibit prolonged service life and do not contaminate the electrolyte.

As a result of using an inorganic compound pore former, numerous benefits are derived. The leaching step may be performed by using an aqueous solution. The aqueous solution dissolves the inorganic compound pore former, while not significantly attacking nor dissolving the electroconductive metal coating. One is no longer required to use an acidic or a basic solution to remove the pore former, as is necessary with many of the inventions discussed in the prior art section. In addition to being a much more economical operation, it is a much safer operation because the operator is not required to be exposed to acidic or basic solutions. Although acids or bases may be used to remove the inorganic compound pore former, in most instances water or an electrolyte solution may be used. Another benefit derived from the improvement is that the inorganic compound pore former may be leached while the electrode is in use in an electrolytic cell. If the inorganic compound pore former is selected to correspond to the electrolyte being used in the electrolytic cell, there is no contamination of the electrolyte resulting from the leaching. For example, when sodium chloride is used as the inorganic compound pore former and the electrode is leached while in use as an electrode in a chlor-alkali electrolytic cell, wherein the electrolyte is an aqueous solution of sodium chloride, there is no contamination of the electrolyte.

DETAILED DESCRIPTION OF THE INVENTION

The improvement herein discussed consists of applying, for example by flame or plasma spraying, a particulate inorganic compound pore former in combination with a particulate electronconductive metal onto a metallic substrate. The coated substrate is then treated in a manner necessary to substantially remove the inorganic compound pore former, leaving an electrode with a porous coating.

The electrode substrate which is to be used may be any electrically conductive material having the needed mechanical properties and chemical resistance to the electrolyte solution in which it is to be used. Illustrative of materials that may be used are iron, mild steel, stainless steel, titanium, nickel and the like. Preferably, the electrode substrate will be foraminous (metal screen, expanded metal mesh, performated metal, and the like) to facilitate the generation, flow and removal of hydrogen formed during electrolysis at the electrode surface.

Prior to being coated, the surfaces of the electrode substrate are usually cleaned to remove any contaminants and to insure good adhesion of the coating. Cleaning techniques such as vapor degreasing, chemical etching, and/or grit blasting and the like or combinations of such means may be used.

All or any part of the electrode substrate surface may be coated and the coating may be applied before or after forming the electrode substrate into the desired electrode configuration.

Coating should commence soon after preparation, usually within one hour, to eliminate possible surface degradation. A commercial plasma spray unit may be used when coating. In order to obtain the desired porosity, it is necesary to add a pore former to the coating material. Coating parameters may be taken from the plasma sprayer vendor's data. Equipment setting may require minor adjustments for spraying powder mixtures. The pore shapes, and sizes can be varied by varying the sizes of the powders in the sprayed mixtures. The amount of porosity is controlled by the quantity of pore former added and the coating thickness is readily varied by the coating time per unit area.

Small pore sizes restrict the gas-liquid transport in the coating during operation; therefore, pores should be open pores and should be over about one micron in size. The inorganic compound pore former powder should be about the same size as the coating material. If it is much smaller the result is closed pores and if it is much larger the coating powders do not overlap each other and the coating is not adherent. Voltage reductions were noted for inorganic compound pore former compositions up to about 80 volume percent. Above this the coating particles did not overlap well and large coating losses were noted. Thicker coating provides greater surface areas for the same coating but the transport of the gases may be hindered; therefore, larger pore sizes are recommended for thicker coatings. The pore size is limited by the plasma spray system. Generally powders greater than a few hundred microns in diameter cannot be sprayed satisfactorily.

It has been found that the benefits of using these electrodes persists over extended periods. Cells containing electrodes made by this invention have been tested in typical industrial electrolytic cells and it was found that they will maintain significant operating advantages over the performance of wholly conventional cells.

The particulate metal or metals employed to coat the substrate may be a neat metal, a mixture of neat metals or alloys of two or more metals, each of which may contain normally occurring impurities. The particle size of the screened particulate metals should be within the range of about 10 to about 160 microns, and preferably 40 to 120 microns. The metals which can be employed for coating the cathode substrate are those metals, alloys and compounds of Groups I-B, V-B, VI-B, VII-B and VIII of the Mendeleev Periodic Table, as well as compounds off these metals with one or more of the following elements boron (B), carbon (C), nitrogen (N), silica (Si), phosphorous (P), sulfur (S), arsenic (AS), selenium (Se), and tellurium (Te).

The above metals or compounds in particulate form are employed in combination with an inorganic compound pore former which is removable (leachable) from the metal and unreactive with the metal. The inorganic compound pore former is provided in a particulate form in a size range from about 10 to about 160 microns which may be the same size, larger or smaller than the metal particulate. Suitable inorganic compound pore formers are the alkali metal and alkaline earth metal compounds which are stable at the temperature of application. It is critical to the invention that the inorganic compound pore former be soluble in an aqueous solution. Particularly suitable are those compounds which are combinations of the elements of groups 1a and 2a of the Periodic Table with elements in the group 6a and group 7a, such compounds being soluble in an aqueous solution. Most particularly suitable are the halides of the elements listed in group 1a of the Periodic Table. The solubility of the various compounds differ. However, all will be acceptable so long as they are soluble even if to only a small degree. Solubilities of these various compounds are known or are readily available to those skilled in the art. Other compounds having the requisite removal capabilities, non-reactiveness and thermal stability may be used.

The means for removing the inorganic compound pore former from association with the metal after application to the substrate is preferably by water leaching although an acid or base leaching or even volatilization may be employed.

The spraying parameters, such as the volume and temperature of the flame or plasma spraying stream, the spraying distance, the feed rate of particulate coating constituents and the like, are chosen so that the particulate components of the coating admixture are partially melted by and in the spray stream and deposited on the cathode substrate while still substantially in partially melted form so as to provide an essentially continuous coating having a foraminous structure. Typically, spray parameters like those used in the examples give satisfactory coatings. Generally, slightly better results with respect to decreased hydrogen overvoltage are obtained by maintaining the electrode substrate during melt spraying near ambient temperature. This may be achieved by means such as streams of air impinging on the substrate during spraying or allowing the substrate to air cool between spray passes.

After the admixture of the electroconductive metal and the inorganic compound pore former has been applied, the electrode is then subjected to conditions whereby the inorganic compound pore former is removed, leaving a porous metallic coating on the electrode.

There are numerous means by which the inorganic compound pore former may be removed. One, for example, is to immerse the coated electrode into an acidic or basic solution. The acid or base attacks the inorganic compound and removes it by either reacting with it or dissolving it. If calcium oxide (CaO) is used as the pore former, an acid, such as HCl, would react with the CaO and form calcium chloride and water. The calcium chloride is then dissolved by the remaining HCl solution. Thus, the inorganic compound is removed leaving a porous coating on the electrode. Other acids could obviously be used, as well as various basic solutions. The use of an acid or a base will depend upon the inorganic compound used as the pore former.

Another way to remove the inorganic compound pore former is to dissolve the inorganic compound by immersing the electrode in water. The water attacks the inorganic compound and dissolves it from the coating. Obviously, some inorganic compounds are more readily soluble in water than are others. The use of this means to remove the inorganic compound will depend somewhat upon the inorganic compound used as a pore former. For example, if sodium chloride (NaCl) is used as the inorganic compound pore former, it is readily soluble in water and would be quickly removed by the water. Even if the inorganic compound is not as readily soluble in water as is sodium chloride, the solubility rate may be increased by raising the temperature of the water, agitation of the water, additional time and other well known techniques.

Another means which may be used to remove the inorganic compound is to allow an electrolytic solution to dissolve the inorganic compound while the electrode is in use in an electrolytic cell. This method has the added benefit of not contaminating the electrolyte if the inorganic compound is selected to correspond to the electrolyte being used in the electrolytic cell. For example, if sodium chloride is used as the inorganic compound pore former, the electrode may be installed into a chlor-alkali electrolytic cell and be leached by the electrolyte without contaminating it. The electrolyte in a chlor-alkali cell is a brine solution of sodium chloride and will obviously not be contaminated when it dissolves the sodium chloride that was used as the inorganic compound pore former.

Some of the inventions in the prior art show that the pore former may be leached while in use in an electrolytic cell, however, the leaching of those prior art pore formers will contaminate the electrolyte. Even if the prior art coatings are leached before they are used as an electrode in an electrolytic cell, there will generally be a certain amount of residual pore former left in the electrode coating. This residue will contaminate the electrolyte, when the electrode is subsequently used as an electrode. The present invention avoids this problem.

EXAMPLES

EXAMPLE I

SAE 1008 punched plate steel cathodes approximately 3 inches by 3 inches were cleaned in 1,1,1-trichloroethane, air dried, washed with 6 N hydrochloric acid to remove scale, rinsed with deionized water and air dried. The cathodes were blast cleaned with 36 mesh alumina to obtain a highly disrupted surface. The cathodes were coated by plasma spray with a 60% nickel particulate (40–120 micron particulate size) admixed with a 100 micron sodium chloride power. The coating was about 0.020 inches thick. These cathodes were tested in a plastic box containing a two liter anolyte chamber separated from a four-liter catholyte chamber by an ion-exchange membrane. The catholyte and anolyte were each 100 grams per liter sodium hydroxide and 180 grams sodium chloride. Cathodes were leached in water to remove the salt prior to testing.

Current was brought to the electrodes by a brass rod brazed to the cathode and a titanium rod welded to the anode. The anode was a coated titanium electrode. The temperature of the cell was maintained at 70±1° C. Power was supplied to the cell by a current-regulated power supply. Electrolysis was conducted at an apparent current density of 0.5 amps per square inch (6.45 $cm^2$) of cathode area. The cathodic voltage was measured against a saturated calomel electrode at 25° C. This reference electrode was connected adjacent to the cathode by means of a saturated potassium chloride salt bridge (Luggin probe type).

The two cathodes coated as above described showed cathodic voltages of −1.292 and −1.286 volts.

EXAMPLE II

An SAE 1008 plate steel cathode was prepared by bending a 21 inch by 21 inch (53.34 cm by 53.34 cm) steel sheet in the middle and welding each end together. This envelope had a 0.25 inch opening on the inside. Bolts 0.5 inch (1.27 cm) diameter by 2 inches (6.45 cm) long were welded to the open edge of the envelope so that it would be attached in an electrolysis cell. The cathode was cleaned in 1,1,1-trichloroethane, followed by blast cleaning with 36 mesh alumina to obtain a highly disrupted surface. The cathode was coated by plasma spraying with a 75 weight percent nickel particulates (−325 mesh particulate size) admixed with c.a. 100 micron sodium chloride powder. The coating was about 0.014 inches thick and weighed 738 grams. Sodium chloride was leached from the coating with water.

The cathodes were tested in a plastic box containing an anolyte chamber and a catholyte chamber separated by an ion-exchange membrane. The catholyte and anolyte were each 100 grams per liter sodium hydroxide and 180 grams per liter sodium chloride. Current was brought to the cathode by copper bus bar attached to the bolts. The anodes were two coated titanium electrodes placed on either side of the cathode. The temperature of the cell was maintained at 70±1° C. Power was supplied to the cell by a current-regulated power supply. Electrolysis was conducted at an apparent current density of 0.5 amps per square inch (6.45 $cm^2$) of cathode area. The cathodic voltage was measured against a saturated calomel electrode at 25° C. This reference electrode was connected adjacent to the cathode by means of a saturated potassium chloride salt bridge (Luggin probe type).

The cathode coated as above described showed cathodic voltage of −1.235 volts.

EXAMPLE III

The cathode described in Example II was removed from the test cell. A diaphragm was deposited from an asbestos slurry onto the cathode in a conventional manner. The cathode was then tested in a conventional diaphragm chlorine cell. The anodes were coated titanium electrodes placed about 0.25 inches (0.635 cm) on either side of the cathode. Current was brought to the cathode as noted above. A 300 gram per liter sodium chloride solution was fed continuously to the anolyte compartment. Chlorine, hydrogen, and sodium hydroxide-sodium chloride solution were withdrawn continuously from the cell. Power was supplied to the cell by a current-regulated power supply. Electrolysis was conducted at an apparent current density of 0.5 amps per square inch (6.45 $cm^2$) of cathode. The cathode voltage was measured in this cell against a saturated calomel reference electrode at 25° C. using a saturated potassium chloride salt bridge (Luggin probe).

The coated cathode described above was operated in the described cell for over five months. The cathodic voltage was typically −1.207 volts at 68° C. and in a catholyte solution of 97 grams per liter sodium hydroxide and approximately 180 grams per liter sodium chloride.

We claim:

1. An improvement in the process for preparing electrodes having a porous coating including the steps of
   (a) coating an electroconductive electrode substrate with an admixture of:
      (1) an electroconductive metal; and
      (2) a pore former; and
   (b) removing the pore former from the electrode coating,
   wherein the improvement consists of removing the pore former while the electrode is in use in an electrolytic cell.

2. The process of electrolyzing an electrolyte in an electrolytic cell wherein:
   (1) the electrode is coated with an admixture of an electroconductive metal and an inorganic compound; wherein said inorganic compound is selected so that it is the same salt that is contained in the electrolyte;
   (2) the electrode is placed in use in the electrolytic cell; and (3) the inorganic compound is leached by the electrolyte, leaving a porous coating on the electroconductive metal.

3. The process of claim 2 wherein the electrolyte is an aqueous solution of a metal salt.

4. The process of claim 2 wherein the electrolyte is an aqueous solution of an alkali metal halide.

5. The process of claim 2 wherein the coated electrode is used as a cathode.

6. The process of preparing electrodes having a porous coating comprising the steps of:

(a) coating an electroconductive electrode substrate, using plasma spraying techniques, with an admixture of (i) an electroconductive metal; and (ii) an inorganic compound which is soluble in an aqueous solution; and (b) removing the inorganic compound from the electrode coating.

7. The process of preparing electrodes having a porous coating comprising the steps of:

(a) coating an electroconductive electrode substrate, using flame spraying techniques, with an admixture of:

(i) an electroconductive metal; and (ii) an inorganic compound which is soluble in an aqueous solution; and (b) removing the inorganic compound from the electrode coating.

8. The process of preparing electrodes having a porous coating comprising the steps of:

(a) coating an electroconductive electrode susbstrate with an admixture of:

(1) electroconductive metallic compound, which is composed of at least one element selected from the group consisting of the elements listed in Groups I-B, V-B, VI-B, VII-B and VIII of the Mendeleev Periodic Table and at least one other element which is selected from the group consisting of one or more of the elements in the class consisting of boron, carbon, nitrogen, silicon, phosphorous, sulfur, arsenic, selenium and tellurium; and (2) an inorganic compound soluble in an aqueous solution; and (b) removing the inorganic compound from the electrode coating.

9. The process of preparing electrodes having a porous coating comprising the steps of:

(a) coating an electroconductive electrode substrate with an admixture of:

(1) an electroconductive metal; and (2) an inorganic oxide soluble in an aqueous solution; and (b) removing the inorganic oxide from the electrode coating.

10. The process of preparing electrodes having a porous coating comprising the steps of:

(a) coating an electroconductive electrode substrate with an admixture of:

(1) an electroconductive metal; and (2) an inorganic sulfide soluble in an aqueous solution; and (b) removing the inorganic sulfide from the electrode coating.

11. The process of preparing electrodes having a porous coating comprising the steps of:

(a) coating an electroconductive electrode substrate with an admixture of:

(1) an electroconductive metal; and (2) an inorganic compound soluble in an aqueous solution; and (b) removing the inorganic compound from the electrode coating while the electrode is in use in an electrolytic cell.

12. An improvement in the process for preparing electrodes having a porous coating including the steps of:

(a) coating an electroconductive electrode substrate with an admixture of:

(1) an electroconductive metal; and (2) a pore former; and (b) removing the pore former from the electrode coating, wherein the improvement consists of using, as the pore former, an inorganic compound which is soluble in an aqueous solution and is selected to match the composition of an electrolyte which is to be used in an electrolytic cell, so that no contamination of the electrolyte occurs when the inorganic compound is leached by the electrolyte.

13. The product produced by the process of claims 1, 2, 6, 7, 9, 10, 11 or 12.

* * * * *

UNITED STATES PATENT AND TRADEMARK OFFICE

CERTIFICATE OF CORRECTION

PATENT NO. : 4,279,709

DATED : July 21, 1981

INVENTOR(S) : John M. McIntyre, et al.

It is certified that error appears in the above-identified patent and that said Letters Patent are hereby corrected as shown below:

Col. 3, line 10, delete "sacrifical" and insert therefor --sacrificial--.

Col. 4, line 37, delete "electronconductive" and insert therefor --electroconductive--.

Col. 4, line 66, delete "necesary" and insert therefor --necessary--.

Col. 5, line 42, delete "off" and insert therefor --of--.

Col. 7, Example II, line 56, before "plate" add the word --punched--.

Col. 7, Example II, line 62, delete "would" and insert --could--.

Signed and Sealed this

*Tenth* Day of *November 1981*

[SEAL]

*Attest:*

GERALD J. MOSSINGHOFF

*Attesting Officer*

*Commissioner of Patents and Trademarks*